US006367644B1

(12) United States Patent
Reutter

(10) Patent No.: US 6,367,644 B1
(45) Date of Patent: Apr. 9, 2002

(54) SEALING CAP

(76) Inventor: Heinrich Reutter, Theodor-Heuss-Strasse 12, D-71336 Waiblingen (DE)

( * ) Notice: Subject to any disclaimer, the term of this patent is extended or adjusted under 35 U.S.C. 154(b) by 0 days.

(21) Appl. No.: 09/555,507

(22) PCT Filed: Nov. 25, 1998

(86) PCT No.: PCT/EP98/07590

§ 371 Date: Jun. 5, 2000

§ 102(e) Date: Jun. 5, 2000

(87) PCT Pub. No.: WO99/28605

PCT Pub. Date: Jun. 10, 1999

(30) Foreign Application Priority Data

Dec. 3, 1997 (DE) ..... 197 53 592

(51) Int. Cl.[7] ..... B65D 51/16; F01P 11/02

(52) U.S. Cl. ..... 220/203.26; 220/203.28; 220/304; 220/DIG. 32

(58) Field of Search ..... 220/303, 304, 220/203.23, 203.24, 203.25, 203.26, 203.27, 203.28, 203.29; 236/34.5; 180/68.4

(56) References Cited

U.S. PATENT DOCUMENTS 2,732,971 A 1/1956 Holmes et al.
5,174,463 A * 12/1992 Scharrer ..... 220/DIG. 32

FOREIGN PATENT DOCUMENTS

| | | |
|---|---|---|
| DE | 871227 | 2/1953 |
| DE | 1297936 | 6/1969 |
| DE | 3211449 A1 | 10/1983 |
| DE | 3422705 A1 | 12/1985 |

(List continued on next page.)

*Primary Examiner*—Nathan J. Newhouse
(74) *Attorney, Agent, or Firm*—Jones, Tullar & Cooper, P.C.

(57) ABSTRACT

The invention relates to a sealing cap for openings in motor vehicle radiators which is provided with a cap inner part (4) having a flow connection between the interior of the container and the exterior of the container as well as a valve arrangement (5) for unblocking and blocking the flow connection. The valve arrangement (5) comprises a first (7) and second (8) valve body which can move between an unblocking position and a blocking position in a to-and-fro manner. The first valve body (7) is prestressed in the direction toward the interior of the container and is supported in this direction on a first sealing seat (13) located on the cap inner part (4) and on a second sealing seat (14) located on the second valve body (8), said second sealing seat lying inside the first sealing seat (13) in a radial manner. During unblocking of a fluid connection between the interior of the container and the exterior of the container, the first valve body can be respectively lifted from the cap inner part (4) when a first limiting value of the container interior pressure is exceeded and can be lifted from the cap inner part (4) and the second valve body (8) when a safety limiting value of the container interior pressure is exceeded. The second valve body (8) is configured as a structural component (8) which extends perpendicular to the direction of movement of the valve body (7, 8). The structural component has an opening (15) which lies inside the second sealing seat (14) of the first valve body (7) in a radial manner and which is fluid connected to the interior of the container. A third sealing seat (26) provided on the cap inner part (4) is assigned to said structural component outside the second sealing seat (14) of the first valve body (7) in a radial manner up-to the exterior of the container. The structural component lies on the third sealing seat at a third limiting value which is between the first and second limiting value for the container interior pressure, whereby the component blocks a previously existing flow connection between the interior of the container and the exterior of the container.

13 Claims, 7 Drawing Sheets

FOREIGN PATENT DOCUMENTS

| | | | |
|---|---|---|---|
| DE | 4107525 | C1 | 5/1992 |
| DE | 4124182 | C1 | 6/1992 |
| DE | 4220631 | C1 | 3/1993 |
| DE | 4422292 | A1 | 12/1995 |
| DE | 3832103 | C2 | 8/1996 |
| EP | 0177860 | A2 | 4/1986 |
| EP | 0520135 | B1 | 12/1992 |
| FR | 2509789 | | 1/1983 |

* cited by examiner

SEALING CAP

FIELD OF THE INVENTION

The present invention relates to a sealing cap for openings of containers, in particular of motor vehicle radiators, comprising an inner cap element which provides at least one flow connection between the inside of the container and the outside of the container, and a valve arrangement for releasing and blocking the flow connection. The valve arrangement having a first valve body and a second valve body which can be moved back and forth between at least one release position and at least one blocking position, the first valve body being prestressed in the direction toward the inside of the container and being supported in this direction at a first seal seat on the inner cap element and at a second seal seat located radially within the first seal seat on the second valve body. The first valve seat can be lifted off the inner cap element when a first threshold value of the interior container pressure is exceeded, and can be lifted off the inner cap element and the second body, when a second, preferably a safety threshold value of the inner container pressure, is exceeded, each respectively by releasing a flow connection between the inside of the container and the outside of the container.

BACKGROUND OF THE INVENTION

In connection with a known sealing cap of the type described in DE-41 07 525, a value cup with a radially outwardly extending flange is used as a first valve body, and as a second valve body a cylindrical sleeve concentrically enclosing the valve cup, which is also provided with a radially outwardly protruding flange, the flange seated on the cylindrical sleeve is shaped on the latter in the manner of a bead while forming a bulge. In the initial blocking position of the valve arrangement of the prior art, the cup valve, which is acted upon by a compression spring in the direction toward the container interior, is supported via a seal ring on the mentioned bulge of the second valve body. The cylindrical sleeve, on which a force also acts in is way in the direction toward the interior of the container, is also seated, with the interposition of a sealing ring, with its flange on a seal seat of the inner cap element. In the initial blocking position of the valve arrangement, a further sealing ring, which is corrected with the inner cap element, lies at a distance opposite the flange of the cylindrical sleeve in the direction of the container exterior. The three described sealing rings of the valve arrangement of the known sealing cap are indispensable for the desired two-stage pressure buildup of an overpressure prevailing in the interior of the container.

SUMMARY OF THE INVENTION

It is an object of the present invention to structurally simplify such a sealing cap.

In accordance with the present invention the second valve body is embodied as a component extending transversely with respect to the movement direction of the valve bodies, and has an opening located radially inside the second seal seat of the first valve body and is in flow connection with the inside of the container and to which a third seal is provided which is provided radially outside of the second seal seat of the first valve body in the direction toward the outside of the container on the inner cap element, against which it comes to rest via case of a third threshold value, located between the first and second threshold values of the inner container pressure, in the course of which it blocks a previously existing flow connection between the inside of the container and the outside of the container.

The described component, which is provided with an opening, represents a valve body of the simplest structural design. With an appropriate embodiment, in particular with an appropriate selection of material, a tight support, ie. without any additional sealing means, of the first valve body on the component constituting the second valve body will easily result. The use of such a component as the second valve body moreover provides the opportunity to accomplish the above mentioned blockage of the flow connection between the inside of the container and the outside of the container by means of the direct cooperation between the second valve body and the third seal seat.

In an advantageous manner, the component can be designed either as a radially guided deformable seal, or as a diaphragm, which can be deformed in the direction of movement.

The desired great operational dependability of the valve arrangement is achieved by means of the provision of a deformable seal radially extending with respect to the axial movement, or respectively the provision of a diaphragm guided on the inner cap element and/or the guidance of the component with the aid of a guide sleeve, which is either a part of the deformable seal or is equipped with the diaphragm, can be achieved by structurally simple means.

For aiding a tight contact between the first and second valve body of the sealing caps in accordance with the present invention, at least one spring is provided supported on the inner cap element which prestresses the component against the first valve body.

A preferred embodiment of the sealing caps in accordance with the present invention is distinguished by the provision of a guide sleeve designed with a stepped diameter and an axial section toward the first valve body as well as an axial section toward the bottom and a radial flange connecting the two axial sections on whose side facing the container the spring is supported.

A structurally extremely simple design in combination with the suitability of the second valve body for assuming a sealing function is achieved by means of a diaphragm designed as a rubber ring diaphragm.

The characteristics whereby the diaphragm is designed to have at least one fold are used to assure an even dependable operational behavior of the second valve body, and therefore of the entire valve arrangement.

Against the background that, in connection with sealing caps in accordance with the present invention, the equalization of an underpressure prevailing in the interior of the container should also be possible with structurally simple means, besides a two-stage buildup of an overpressure prevailing in the interior of the container, characterized in that the one of two partial valve bodies of the first valve body, which is supported from the direction of the inside of the container on the other partial valve body, is seated on the component on the outside of the container and sealingly covers the opening, wherein the other partial valve body is supported from the direction of the outside of the container on the first seal seat of the inner cap element and covers the partial valve body seated on the component with an opening, which is connected with the outside of the container, and wherein, by the action of an underpressure on the inside of the container, the partial valve body seated on the component can be lifted off the associated partial valve body, and in the course of this releases a flow connection between the inside of the container and the outside of the container.

In the interest of the simplest possible structural design of the entire arrangement, the partial valve body seated on the component has the second seal seat of the first valve body and is supported via it on the component. The partial valve body which is in contact with the component accordingly takes on a double function. It provides a tight connection between the first and second valve bodies both during the reduction of an overpressure prevailing in the interior of the container and during the equalization of a corresponding underpressure.

If required, the spring, by means of which the diaphragm is stressed against the first valve body, also takes on a double function, with the partial valve body seated on the component is lifted off the associated partial valve body counter to the action of the spring. For one, the spring sees to a tight contact of the diaphragm with the first valve body; it furthermore causes a tight contact of the first with the second valve body.

BRIEF DESCRIPTION OF THE DRAWINGS

Further details of the present invention can be taken from the following description, in which the present invention is described and explained in greater detail by means of the exemplary embodiments represented in the drawings. Shown are.

DESCRIPTION OF THE PREFERRED EMBODIMENT

Figure 1:
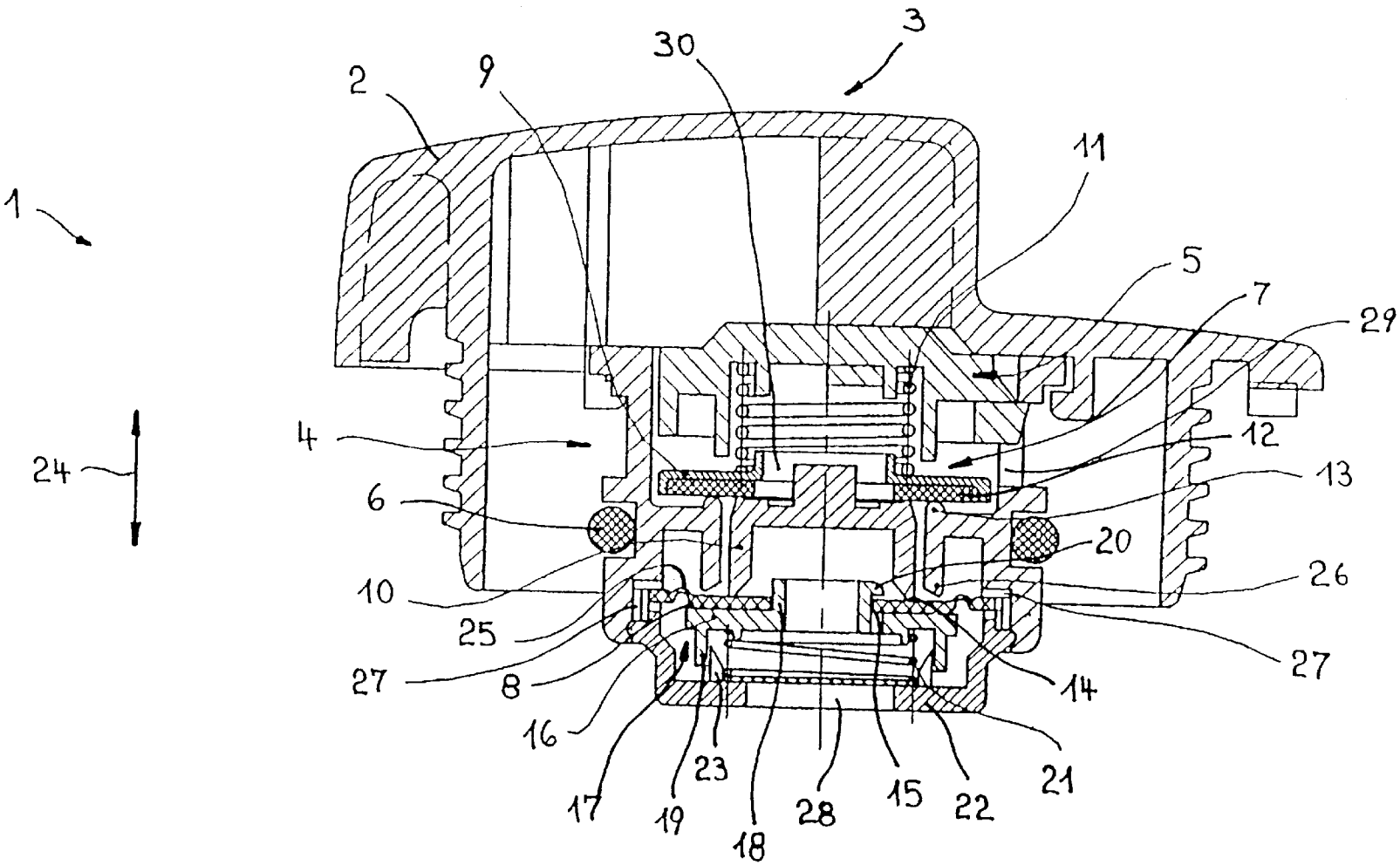
FIG. 1, which is a sealing cap for a motor vehicle radiator with an overpressure/underpressure valve arrangement in the initial blocking position in accordance with a first exemplary embodiment of the present invention, FIG. 2, which shows the sealing cap with the valve arrangement in accordance with FIG. 1 after a first threshold value for an overpressure on the inside of the radiator has been exceeded, FIG. 3, which shows the sealing cap with the valve arrangement in accordance with FIG. 1 with a second threshold value for an overpressure on the inside of the radiator, FIG. 4, which shows the sealing cap with the valve arrangement in accordance with FIG. 1 after a safety threshold value for an overpressure on the inside of the radiator has been exceeded, FIG. 5, which shows the sealing cap with the valve arrangement in accordance with FIG. 1 with an underpressure on the inside of the radiator, FIG. 6, which shows a second embodiment of a sealing cap for a motor vehicle radiator with an overpressure/underpressure valve arrangement in the initial blocking position analogous to FIG. 1, and FIG. 7, which shows a third embodiment of a sealing cap for a motor vehicle radiator with a two-stage overpressure valve arrangement in the initial blocking position analogous to FIG. 1.

In accordance with FIGS. 1 to 5, a sealing cap 1 for a motor vehicle radiator in accordance with the first exemplary embodiment comprises an outer cap element 3 provided with an actuating handle 2, on which an inner cap element 4 with a valve arrangement 5 is maintained. In its position of use, the sealing cap 1 is fixed in place on a radiator filler tube. Here, the inner cap element 4 objects into the radiator filler tube in the direction toward the inside of the radiator. An O-ring 6 seals the inner cap element 4 against the wall of the radiator filler tube.

The valve arrangement 5 in the interior of the inner cap element 4 comprises a first valve body 7, as well as a second valve body in the form of a diaphragm 8. The first valve body 7. consists of two partial valve bodies, namely a first partial valve body designed as a valve plate 9, and a second partial valve body in the form of a valve hood 10.

A locking spring 11, which is supported with its end remote from the valve plate 9 on the inner cap element 4, acts on the top of the valve plate 9. The valve plate 9 is prestressed in the direction toward the inside of the radiator by means of the locking spring 11. The plate is seated via a flat sealing ring 12 on a first seal seat 13 on the inner cap element 4, and in the process it covers the valve hood 10 with an opening 30, which is connected with the outside of the radiator.

The valve hood 10 is supported on a second seal seat 14 on the top of the diaphragm 8, and in the process extends over a central diaphragm opening 15 provided on the latter. The diaphragm 8 rests on a flange 16 of a guide sleeve 17. The guide sleeve 17 is designed with a stepped diameter and has an axial section 18 of lesser diameter, which covers the diaphragm opening 15, as well as a section 19 of greater diameter connected with it via the flange 16. A radial detent projection 20 on the axial section 18 of the guide sleeve 17 secures the latter to the diaphragm 8 in the axial direction. A support spring 21, seated on a bottom 22 of the inner cap element 4, is supported on the underside of the flange 16 of the guide sleeve 17, and acts on the guide sleeve 17 with the diaphragm 8, as well as on the valve hood 10 seated thereon, in the direction toward the outside of the radiator. As a result, the valve hood 10 rests tightly against the underside of the flat sealing ring 12 oriented toward the inside of the radiator. A guide socket 23, slit in the axial direction, on the bottom 22 of the inner cap element 4 assures a defined movement of the guide sleeve 17 in the axial direction.

On its radially outer edge, the diaphragm 9 is clamped on the inner cap element 4, and can be moved, or respectively deformed, in the direction of a two-headed arrow 24 representing the movement direction of the valve bodies 7, 8. The diaphragm 8 is embodied as a rubber ring diaphragm and provided with an expansion fold 25, which is effective in the radial direction of the diaphragm 8, and whose fold ridge extends concentrically with the vertical diaphragm axis.

A third seal seat 26 toward the outside of the radiator is assigned to the diaphragm 8 on its top. In an advantageous manner, it is constituted, the same as the first seal seat 13, directly by a protrusion of the inner cap element 4. Bypass channels 27 in the inner cap element 4 are routed around the clamped-in edge of the diaphragm 8. The sectional planes in FIGS. 1 to 5 have been placed in such a way that they cover two of these bypass channels 27. Viewed from above on a plane extending vertically to the drawing planes of FIGS. 1 to 5, the bypass channels 27 are arranged at a distance from each other in the direction of the radially outer edge of the diaphragm 8.

A bottom opening 28 in the bottom 22 of the inner cap element 4 provides a flow connection between the inside of the radiator and the valve arrangement 5. A radial outlet 29 adjoining the valve plate 9 terminates toward the outside of the radiator.

The initial blocking position represented in FIG. 1 is assumed by the valve arrangement 5 when the interior radiator pressure changes between an underpressure threshold value and a first overpressure threshold value.

Pressure conditions of this type prevail, for example, in connection with a vehicle parked for an extended time, or during the driving operation of the vehicle with sufficient cooling of the coolant on the inside of the radiator by the relative air stream and/or with fan support. In the initial blocking position in accordance with FIG. 1 there is no flow connection between the inside of the radiator and the outside of the radiator via the valve arrangement 5.

If, for example, the vehicle is stopped after prolonged driving, a pressure increase can occur on the inside of the radiator. Because of this, contents of the radiator will flow into the valve arrangement 5 via the bottom opening 28 of the inner cap element 4 and will fill up all free spaces upstream of the valve plate 9. Contents of the radiator flow in particular through the bypass channels 27 around the diaphragm 8 into the part of the valve arrangement 5 which is located downstream, when viewed from the direction of the diaphragm 8.

If the interior radiator pressure exceeds a first overpressure threshold value, the valve plate 9 is lifted by the contents of the radiator counter to the effect of the locking spring 11 off the first seal seat 13 on the inner cap element 4. In that case the valve arrangement 5 is in the operational state in accordance with FIG. 2, wherein the contents of the radiator flow off through the bottom opening 28, the slit openings of the slit guide socket 23, the bypass channels 27, the space between the diaphragm 8 and the third seal seat 26, the space between the valve hood 10 and the inner wall of the inner cap element 4 adjoining it in the flow direction, and the space between the first seal seat 13 and the flat sealing ring 12, and finally through the radial outlet 29 to the outside of the radiator of the radiator. In the course of this, the valve hood 10 is tightly seated with the second seal seat 14 on the top of the diaphragm 8. The amount of the radiator contents flowing out of the inside of the radiator is defined by the bypass channels 27, or respectively by the flow cross section.

If the overpressure on the inside of the radiator continues to increase, the diaphragm 8 moves, or respectively is deformed until, at a second threshold value of the overpressure on the inside of the radiator, it sealingly comes into contact with the third seal seat 26 of the inner cap element 4. In this position the diaphragm 8 blocks the flow connection which had previously existed between the inside of the radiator and the outside of the radiator via the bypass channels 27. In the course of its lifting movement out of its position in accordance with FIG. 2 into its position in accordance with FIG. 3, the diaphragm 8 is guided in the movement, or respectively deformation direction, by means of the guide sleeve 17 on the guide socket 23. In the operational state of the valve arrangement represented in FIG. 3, the inside of the radiator is again sealed against the outside of the radiator. By means of the blockage of the flow connection between the inside of the radiator and the outside of the radiator it is prevented that the radiator boils dry.

Figure 3:
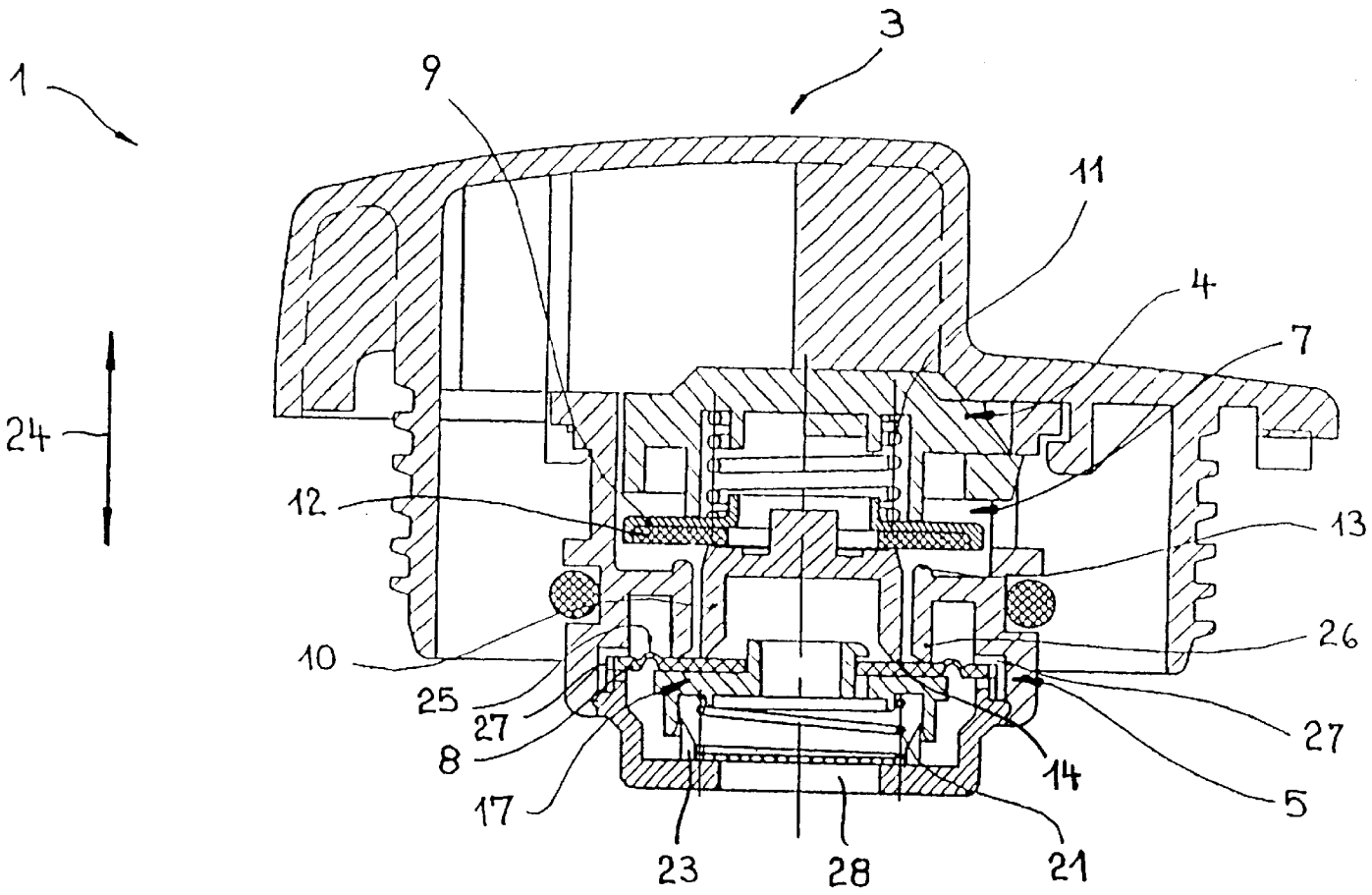

If the overpressure on the inside of the radiator continues to increase and finally exceeds a third threshold value in the form of a safety threshold value, the valve hood 10 is lifted by the effects of the interior radiator pressure, starting in its position in accordance with FIG. 3, off the diaphragm 8, which is supported on the third seal seat 26 in the direction toward the outside of the radiator. The operational state of the valve arrangement 5 then arising can be seen in FIG. 4. In accordance with this, the radiator contents flows via the bottom opening 28, the interior of the guide sleeve 17, the space remaining between the second seal seat 14 at the valve hood 10 and the top of the diaphragm 8, as well as the space between the axis-parallel wall of the valve hood 10 and the inner wall of the inner cap element 4 located opposite it, and finally between the first seal seat 13 and the underside of the flat sealing ring 12 of the valve plate 9 to the radial outlet 29, and through it to the outside of the radiator.

Figure 2:
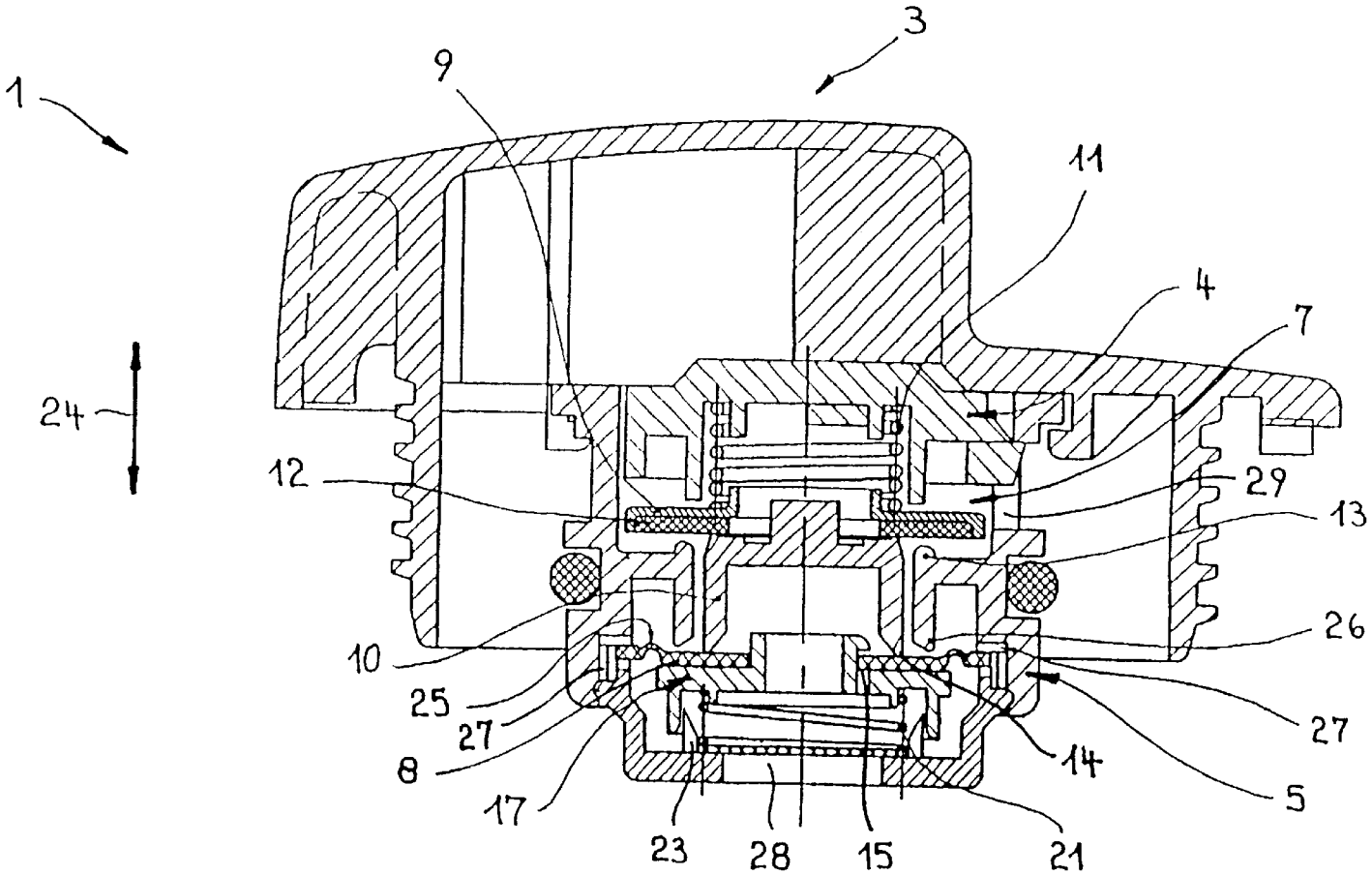
Figure 4:
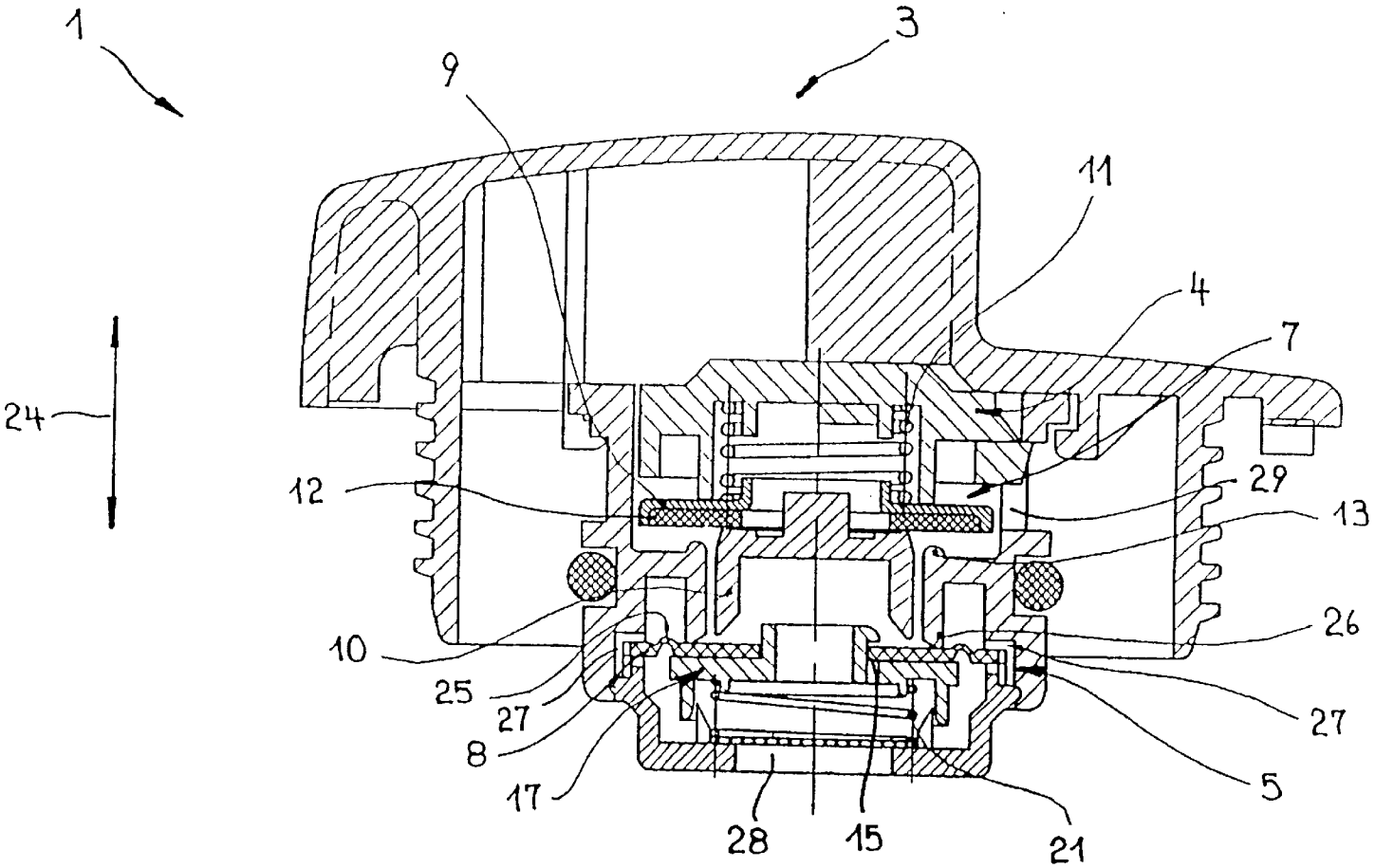

Following the release of the overpressure on the inside of the radiator, the valve arrangement 5 moves from its operational state in accordance with FIG. 4 through the previously explained operational states in accordance with FIGS. 3 and 2, until finally it again takes up its initial blocking position in accordance with FIG. 1.

If an underpressure prevails on the inside of the radiator, and if this underpressure falls below a predetermined threshold value, starting in the situation in accordance with FIG. 1, the valve hood 10 is lifted off the underside of the flat sealing ring 12 of the valve plate 9 in the direction toward the inside of the radiator. In the process, the valve plate 9, on which the locking spring 11 acts, is supported via the flat sealing ring 12 on the first seal seat 13 of the inner cap element 4. With the second seal seat 14, the valve hood 10 is tightly seated on the top of the diaphragm 8 and is lowered, together with the latter, towards the inside of the radiator against the action of the support spring 21. In the process, the same as in the course of the movement caused by the overpressure on the inside of the radiator, the diaphragm 8 is also guided by means of the guide sleeve 17 and the guide socket 23 operating together with it. In both movement, or respectively deformation directions of the diaphragm 8, the expansion fold 25 assures its even, dependable operational behavior.

Figure 5:
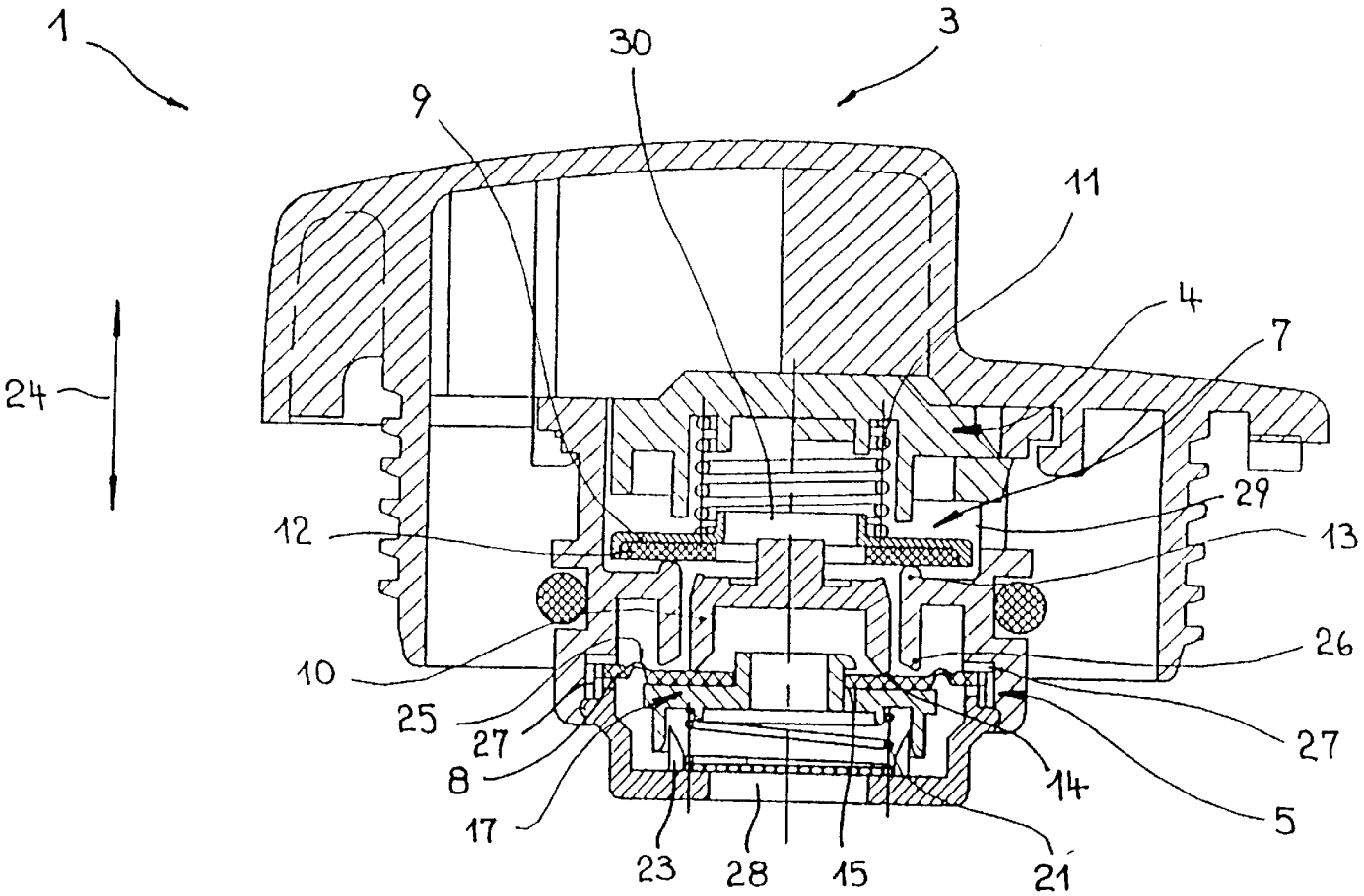

As can be seen in FIG. 5, in case of an underpressure on the inside of the radiator falling below a predetermined threshold value, there is the possibility for a pressure equalization via the radial outlet 29, the space between the valve plate 9 and the valve hood 10, the space between the axis-parallel outer wall of the valve hood 10 and the inner wall of the inner cap element 4 located opposite it, the space between the third seal seat 26 and the top of the diaphragm 8, the bypass channels 27, the slit openings of the guide socket 23 at the bottom 22 of the inner cap element 4, as well as the bottom opening 28. By means of an appropriate design of the front face of the axial section 19 of the guide sleeve 17 facing the bottom 22 of the inner cap element 4, it is prevented that, in case of an extremely large pressure difference between the inside of the radiator and the outside of the radiator, the axial section 19 of the guide sleeve 17 is placed with its entire surface sealingly on the bottom 22 of the inner cap element 4 and because of this blocks the flow connection between the outside of the radiator and the inside of the radiator, which permits the desired pressure equalization. Thus, protrusions, which are arranged spaced apart from each other in the circumferential direction, are provided on the said front face of the axial section 19 of the guide sleeve 17, on which the guide sleeve 17 is supported on the bottom 22, if required, and between which flow-through openings remain.

As soon as the underpressure existing on the inside of the radiator is equalized, the support spring 21, which had been compressed in accordance with FIG. 5, lifts the diaphragm 8, as well as the valve hood 10 supported thereon, until the valve hood 10 comes to rest on the underside of the flat sealing ring 12 of the valve plate 9, and the conditions represented in FIG. 1 are again achieved.

Figure 6:
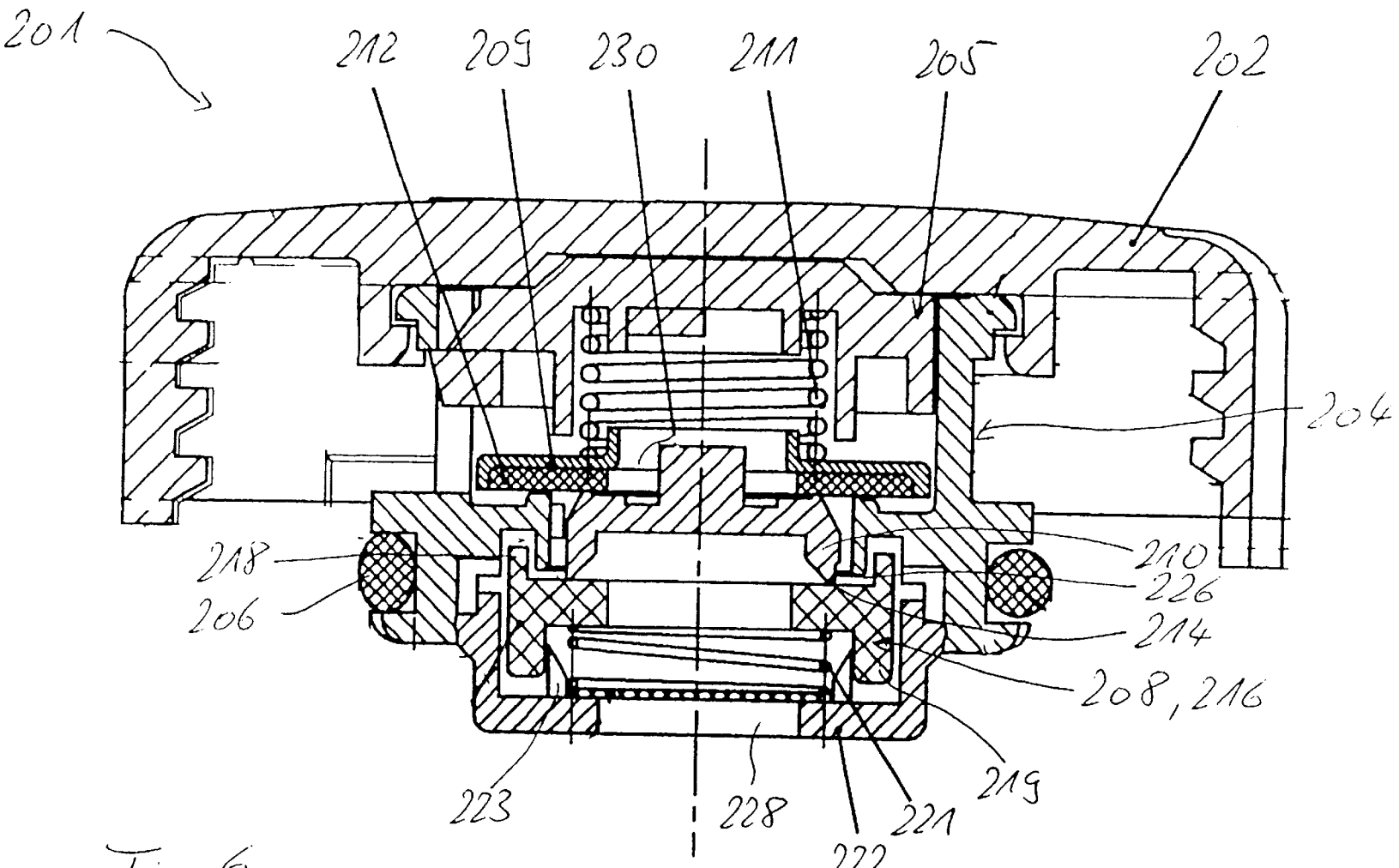

The second exemplary embodiment represented in FIG. 6 essentially differs from the first exemplary embodiment represented in FIGS. 1 to 5 by the design of the second valve body 208. This second valve body 208 is constituted by a deformable seal 208, which is of one piece with the flange 216. The deformable seal 208, 216 designed in this way has a defined Shore A hardness, so that it can directly serve and act as a seal against the second seal seat 214 on the valve hood 210 and against the third seal seat 226 of the inner cap element 204. The deformable seal 208, or respectively the flange 216, have an axial section 219 oriented toward the bottom 222 of the inner cap element 204 which, as in the first exemplary embodiment, is radially guided for axial movement on the guide socket 223 projecting from the bottom 220. An axial section 218 is provided opposite this axial section 219, which enters an annular groove of the inner cap element 204 formed by an area of the outer circumference and the inner ring area of the inner cap element 4, which is included in forming the third seal seat 226. This axial section 228 is used as a baffle, or respectively a restriction, of the flow through-opening from the bottom opening 228 to the underside of the valve plate 209 in the initial blocking position represented in FIG. 6. Since, unlike the diaphragm 8, the deformable seal 208 is not connected with the inner cap element 204, a respective bypass channel in the inner cap element is not necessary. The further design, and the further overpressure/underpressure function in particular, is the same as in the first exemplary embodiment in FIGS. 1 to 5, so that reference is made to this description.

Figure 7:
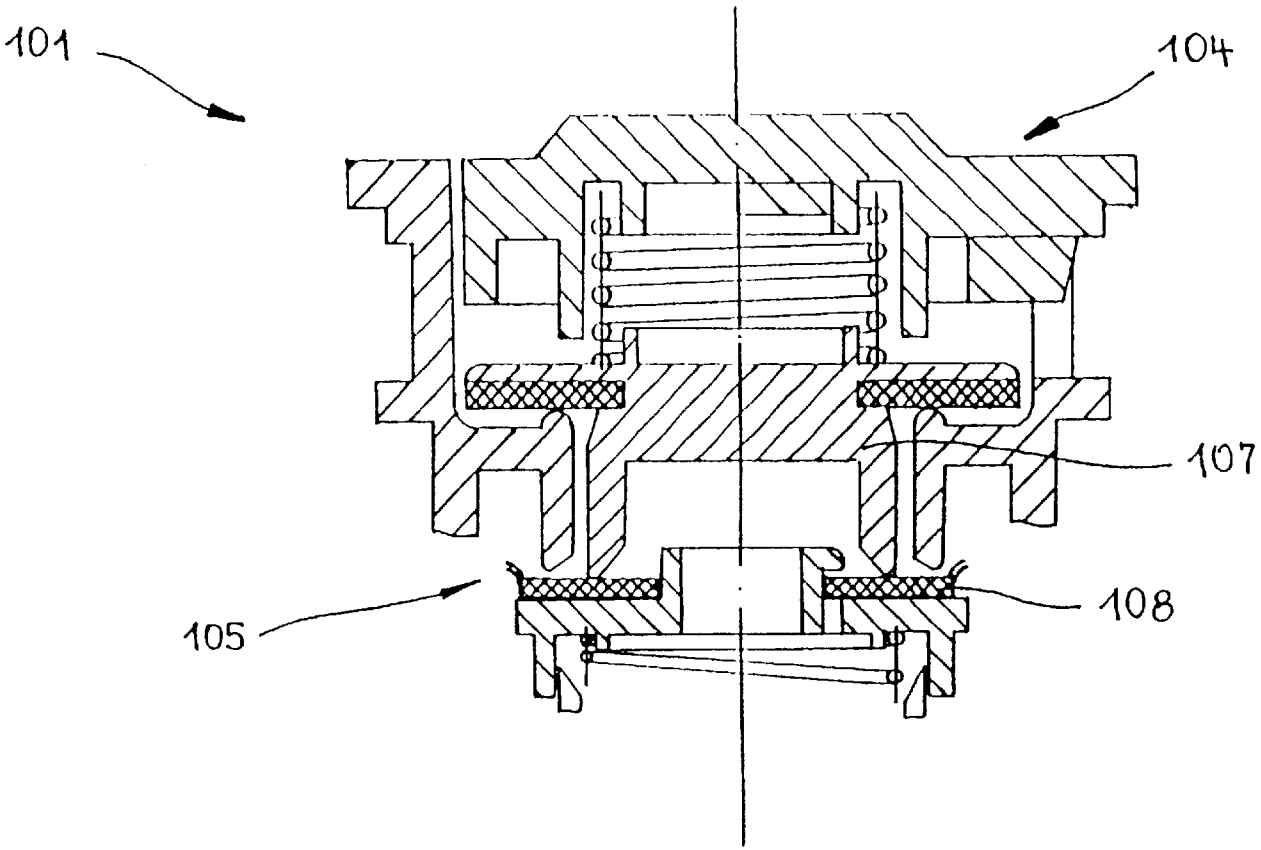

An inner cap element 104 of a sealing cap 101, which is also intended for use in connection with a motor vehicle radiator, is represented in FIG. 7, but it makes use of a valve arrangement 105, by means of which only an overpressure prevailing on the inside of the radiator can be reduced in two stages in the manner described above. No provisions for equalizing an underpressure on the inside of the radiator have been made in connection with the embodiment in accordance with FIG. 7. In contrast to the sealing cap 1 in accordance with FIGS. 1 to 5, a first valve body 107 made in one piece is provided on the sealing cap 101. When the underpressure function is omitted, it is possible to do without a two-part design of the first valve body 107 with two valve bodies, such as is provided in the exemplary embodiment in accordance with FIGS. 1 to 5. Otherwise the design and function of the sealing cap 101 in accordance with FIG. 7 corresponds identically to the sealing cap 1 of FIGS. 1 to 5. In particular, a second valve body in the form of a diaphragm 108 is also employed with the sealing cap 101. It, as well as other components of the entire arrangement, is only partially represented in FIG. 7. It is understood that this third exemplary embodiment in accordance with FIG. 7 can also be altered in the way of the embodiment of the second valve body 208 of the previously described second exemplary embodiment in accordance with FIG. 6.

What is claimed is:

1. A sealing cap for container openings, comprising:

an inner cap element which provides at least one flow connection between the inside and the outside of the container; and a valve arrangement for releasing and blocking the flow connection, said valve arrangement having a first valve body and a second valve body moved back and forth between at least one release position and at least one blocking position, said first valve body being prestressed in the direction toward the inside of the container and being supported in this direction at a first seal seat on said inner cap element, and at a second seal seat, located radially within said first seal seat on said second valve body, wherein said first valve body is lifted off said inner cap element when a first threshold value of the pressure in the interior container is exceeded, and is lifted off said inner cap element and said second valve body, when a second, safety threshold value of the pressure in the interior container is exceeded, each respectively by releasing a flow connection between the inside of the container and the outside of the container, and wherein said second valve body is embodied as a component extending transversely with respect to the movement direction of the valve bodies, said second valve body having an opening located radially inside said second seal seat of said first valve body which is in flow connection with the inside of the container and to which a third seal seat is provided, which is provided radially outside of said second seal seat of said first valve body in the direction toward the outside of the container on said inner cap element against which it comes to rest under the influence of a third threshold value, situated between said first and second threshold values of the inner container pressure, in the course of which it blocks a previously exiting flow connection between the inside of the container and the outside of the container.

2. The sealing cap as defined in claim 1, wherein said component comprises a deformable seal radially extending with respect to the axial movement.

3. The sealing cap as defined in claim 2, wherein said inner cap has a guide socket, and wherein said deformable seal is made as one piece with a guide sleeve displaceably guided in the direction of movement of said deformable seal on said guide socket.

4. The sealing cap as defined in claim 1, wherein said component comprises a diaphragm with an outside edge, and wherein said diaphragm is deformed in said movement direction and said outside edge is held on said inner cap element.

5. The sealing cap as defined in claim 4, wherein said diaphragm is guided on said inner cap element during the course of the deformation in the direction of movement of the valve bodies.

6. The sealing cap as defined in claim 4, wherein said inner cap has a guide socket and said deformable seal is made as one piece with a guide sleeve displaceably guided in the direction of movement of said deformable seal on said guide socket, and wherein said guide sleeve is connected to and guides said diaphragm.

7. The sealing cap as defined in claim 1, further comprising:

at least one spring supported on said inner cap element, wherein said component is prestressed against said first valve body by said at least one spring.

8. The sealing cap as defined in claim 1, further comprising:

a spring; and a guide sleeve, wherein said guide sleeve includes a stepped diameter an axial section toward said first valve body as well as an axial section toward the bottom of the cap and a radial flange connecting the two axial sections, on whose side facing the container said spring, which acts on said component in the direction toward said first valve body is supported.

9. The sealing cap as defined in claim 1, wherein said component comprises a rubber ring diaphragm.

10. The sealing cap as defined in claim 1, wherein said component comprises a diaphragm having at least one expansion fold which is effective in the radial direction.

11. The sealing cap as defined in claim 1, wherein said first valve body has two partial valve bodies, one of said two partial valve bodies is supported from the direction of the inside of the container on the other partial valve body, is seated on said component on the outside of the container and sealingly covers said opening, wherein the other partial valve body is supported from the direction of the outside of the container on said first seal seat of said inner cap element and covers the partial valve body seated on said component, and wherein by the action of an underpressure on the inside of the container, the partial valve body seated on said component is lifted off the associated partial valve body and in the course of this lifting off releases a flow connection between the inside of the container and the outside of the container.

12. The sealing cap as defined in claim 1, wherein the partial valve body seated on said component has said second seal seat and is supported via said second seal seat on said component.

13. The sealing cap as defined in claim 11, further comprising:

a spring which acts on said component, wherein the partial valve body seated on said component is lifted off the associated partial valve body counter to the action of said spring.

* * * * *